US006123331A

United States Patent [19]

Vackier et al.

[11] Patent Number: 6,123,331

[45] Date of Patent: Sep. 26, 2000

[54] SHEET JOGGLER SYSTEM

[75] Inventors: Leo Vackier, 's Gravenwezel; Jean-Paul Martens, Eeklo, both of Belgium

[73] Assignee: Agfa-Gevaert, Mortsel, Belgium

[21] Appl. No.: 08/990,655

[22] Filed: Dec. 15, 1997

[30] Foreign Application Priority Data

Dec. 16, 1996 [EP] European Pat. Off. ..... 96203559

[51] Int. Cl.[7] ..... B65H 29/70; B65H 9/10; B65H 9/00; B65H 9/04

[52] U.S. Cl. ..... 271/233; 271/234; 271/238; 271/240; 271/253; 271/188

[58] Field of Search ..... 271/229, 233, 271/234, 238, 240, 248, 253, 184, 188, 225; 346/134

[56] References Cited

U.S. PATENT DOCUMENTS

| | | | |
|---|---|---|---|
| 4,135,804 | 1/1979 | Schoppe et al. | 355/3 |
| 4,823,159 | 4/1989 | Yamamoto et al. | 355/3 |
| 4,963,896 | 10/1990 | Murasaki et al. | 346/134 |
| 4,989,036 | 1/1991 | Wilson | 355/106 |
| 5,091,754 | 2/1992 | Abe et al. | 355/317 X |
| 5,172,138 | 12/1992 | Okazawa et al. | 346/134 |
| 5,583,663 | 12/1996 | Boeve | 358/487 X |
| 5,618,036 | 4/1997 | Edwards et al. | 271/225 |

FOREIGN PATENT DOCUMENTS

| | | |
|---|---|---|
| 0443590 | 2/1991 | European Pat. Off. . |
| 0457302 | 5/1991 | European Pat. Off. . |

OTHER PUBLICATIONS

Xerox Disclosure, Jan. 1982, Silverberg.
Xerox Disclosure, Ful. 1980, Shuey.

*Primary Examiner*—William E. Terrell
*Assistant Examiner*—K W Bower
*Attorney, Agent, or Firm*—Baker Botts L.L.P.

[57] ABSTRACT

Sheet joggler system with an inlet roller pair (70, 70'), an outlet roller pair (71, 71'), sheet guides (48, 49) determining a curved sheet path between these roller pairs, a sheet supporting plate (65) between the inlet roller pair and the sheet guides, a sheet stop (72) at the lower end of said plate, and lateral sheet aligning members (66, 67).

17 Claims, 5 Drawing Sheets

SHEET JOGGLER SYSTEM

FIELD OF INVENTION

The present invention relates to a method and a system for longitudinally and transversely positioning one or more sheets.

DESCRIPTION OF THE PRIOR ART

Various systems for longitudinally and/or transversely positioning sheets for different applications are known. Many of these systems carry out these two operations in succession. Further, they are rather complicated and not always easy to adjust to accommodate different sheet sizes.

OBJECT OF THE INVENTION

It is the object of the present invention to provide a method and a system for longitudinally and transversely positioning one or more sheets.

It is in particular the object of the invention to provide such a method and system for use in electrostatography, especially for an electrostatographic duplex printer which can also be used for making simplex prints. Suchlike duplex printer is described in our co-pending EP application No. 96 203 558, entitled: "Simplex printing with duplex printer" filed on even day herewith, whereas further details can also be found in our co-pending application PCT 97/04331, entitled "Electrostatic colour printing apparatus".

STATEMENTS OF INVENTION

In accordance with the present invention, a method for longitudinally and transversely positioning at least one sheet, comprises feeding such sheet along a path which is curved around an axis which is transverse with respect to the sheet path and thus supporting the sheet, stopping the feeding of the sheet by causing the sheet to abut with an edge against a fixed stop in order to obtain its desired longitudinal position, and causing while the sheet is on said curved path also a lateral displacement of the sheet in order to obtain its desired lateral position while at the same time increasing the mobility of the suppported sheet to become positioned longitudinally.

The lateral displacement of the sheet occurring while the sheet is curved about a transverse axis, it will be understood that the increased stiffness of the sheet in this direction is favourable for the efficient lateral positioning of the sheet, such as by abutting contact of its lateral edges with suitable positioning means.

The movement of said sheet along a curved path can occur in a first direction, and the abutment of the sheet against a fixed stop can occur while the sheet moves backwardly. The mentioned first direction may run substantially upwardly and said backward movement substantially downwardly.

A suitable embodiment of the invention comprises feeding such sheet(s) at the end of said curved path between a driving roller pair taking an open position prior to the aligning of the sheet(s), and a closed one after such aligning for driving said sheet(s) towards a processing station. The feeding of said sheet(s) towards said path can occur by means of a driven roller pair, one of said rollers causing the trailing end of the sheet(s) to become displaced away from its initial path towards support means adjacent to said one roller and determining therewith a gap in which the trailing sheet end can move backwardly.

The method according to the invention is not limited to the positioning of one sheet only, but can be used for feeding two or even more sheets along such curved path to become mutually positioned, e.g. in an application in which two sheets are taken from a stack of print sheets in the simultaneous production of two simplex prints by means of a duplex printer. In positioning two sheets, it may be advantageous to slightly misalign the sheets in their longitudinal direction by causing them to abut against two respective stops having different positions according to the transport direction of the sheets. This has the advantage that the sheets have an extending leading, resp. trailing margin what may facilitate their separation after procesing.

The invention encompasses also a sheet joggler system for sheet positioning.

In accordance with the invention, such system comprises a driven sheet inlet roller pair, a driven sheet outlet roller pair having a closed and an open position, sheet guides determining between both such roller pairs a generally upward sheet path which is curved around an axis which is transverse to the sheet path, sheet supporting means between the inlet roller pair and the sheet guides which extends past one roller of the inlet roller pair and which determines therewith a gap in which a sheet can enter with its trailing end when leaving this roller pair and next moving backwardly, and a sheet stop at the lower end of the sheet supporting means for contact with the trailing edge of a sheet thereby to longitudinally position such sheet, and means located at both lateral sides of the curved sheet path for contacting the lateral edges of a sheet to laterally position such sheet.

The rollers of the inlet roller pair may be located at different heights, the sheet supporting means extending past the lower located roller of this roller pair, and the means for the lateral sheet positioning may comprise a stationary plate on one side of the curved sheet path and a movable one at the opposite side thereof, and means for causing the movable plate to carry out repeated movements in the direction of the opposite, stationary plate.

The term "stationary" does not mean that this plate is immobile, since it may be interesting to make this plate slightly yieldable to accomodate small tolerances on the sheet width.

The lateral sheet alignment plates can be mounted on a mechanism allowing different sheet widths to be set.

The term "sheet" encompasses foils of paper, plastic and the like, either taken from a stack of such foils, or cut from a roll supported in the apparatus.

BRIEF DESCRIPTION OF THE DRAWINGS

The invention will be described hereinafter by way of example with reference to the accompanying drawings wherein.

DETAILED DESCRIPTION OF THE INVENTION

Figure 1:
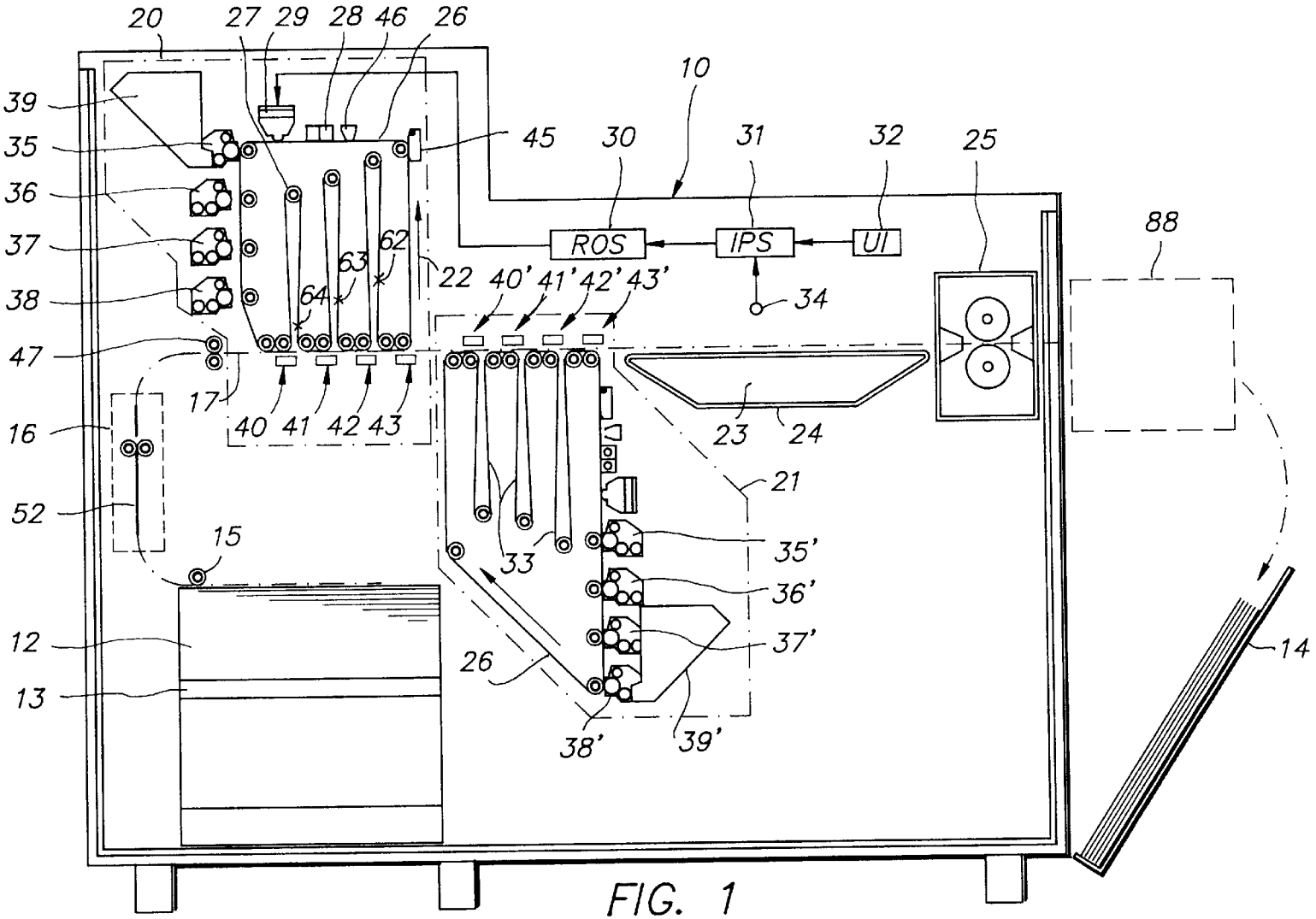
FIG. 1 is a diagrammatic view of one embodiment of an apparatus encompassing a sheet joggler system according to the invention.

FIG. 1 shows a diagrammatic representation of one embodiment of an electrophotographic duplex colour printer, which can be used for the printing of simplex images.

The printer comprises a lighttight housing 10 which has at its inside a stack 12 of sheets to be printed loaded on a platform 13 the height of which is adjusted in accordance with the size of the stack, and at the outside a platform 14 onto which the printed sheets are received.

Sheets to be printed are removed from stack 12 by a dispensing mechanism 15 which may be any mechanism known in the art such as a friction roller, a friction pad, a suction cup or the like for removing each time the top sheet from stack 12.

A removed sheet is passed through alignment station 16 which ensures the correct longitudinal and lateral positioning of the sheet. As the sheet leaves the alignment station, it follows a straight horizontal path 17. The speed of the sheet, upon entering said path can be determined by driven pressure roller pair 47.

The following processing stations are located along path 17. A first image forming station 20 indicated in a dash-and-dot line for applying a colour image to the obverse side of the sheet and a second station 21 for applying a colour image to its reverse side. A buffer station 23 with an endless belt 24 for transporting a sheet to fuser station 25 while allowing the speed of the sheet to decrease because the speed of fuser 25 is lower than the speed of image formation. Fuser station can be any known arrangement in the art, capable of fixing the toner images to their support by contact or radiant heating, contact pressure, etc.

Both image forming stations 20 and 21 being similar to each other, only station 20 will be described in more detail hereinafter.

An endless photoconductor belt 26 is guided over a plurality of idler rollers 27 to follow a path in the direction of arrow 22 to advance successive portions of the photoconductive surface sequentially through the various processing stations disposed about the path of movement thereof. The belt suitably can be a polyethylene terephthalate support which is provided at the outside of its loop with a subbing layer onto which a photoconductive layer has been coated. Means is provided (not shown) for driving the belt at a uniform speed and for controlling its lateral position.

Initially, a portion of photoconductive belt 26 passes through charging station 28. At the charging station, a corona generating device electrostatically charges the belt to a relatively high, substantially uniform potential. Next, the belt is rotated to the exposure station 29, which will expose the photoconductive belt to successively record four latent colour separation images. The exposure station includes a ROS (raster output scanner) 30 with a laser with a rotating polygon mirror block which creates the output printing image by laying out the image in a series of horizontal scan lines, each line having a given number of pixels per inch. However, this station can as well comprise other image-wise exposure systems such as a linear LED array covering the width of the belt for performing the exposure, DMD devices, etc.

The latent images are developed with magenta, cyan, yellow and black developer material. These developed images are transferred on the print sheet in superimposed registration with one another to form a multicolour image on the sheet. The ROS receives its input signal from IPS (image processing system) 31. This system is the electronic control device which prepares and manages the data inflow to scanner 30. A user interface UI, indicated by reference numeral 32, is in communication with the IPS and enables the operator to control the various operator adjustable functions. IPS 31 receives its signal from input 34. This input can be the output of a RIS (raster input scanner) in case the apparatus is a so-called intelligent copier. In such case, the apparatus contains document illumination lamps, optics, a mechanical scanning drive, and a charge-coupled device. The RIS captures the entire original document and converts it to a series of raster scan lines and measures a set of primary colour densities, i.e. red, green and blue densities at each paint of the original document. However, input 34 can as well receive an image signal resulting from an operator operating an image processing station.

After an electrostatic latent image has been recorded on photoconductive belt 26, belt 26 advances this image to the development station. This station includes four individual developer units 35, 36, 37 and 38.

The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the brush of developer material into contact with the photoconductive surface. Developer units 35, 36 and 37, respectively, apply toner particles of a specific colour which corresponds to the compliment of the specific colour-separated electrostatic latent image recorded on the photoconductive surface. The colour of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 10, while the green areas will be reduced to a voltage level ineffective for development. The charged areas are then made visible by having developer unit 35 apply green absorbing (magenta) toner particles onto the electrostatic latent image recorded on photoconductive belt 26. Similarly, a blue separation is developed by developer unit 36 with blue absorbing (yellow) toner particles, while the red separation is developed by developer unit 37 with red absorbing (cyan) toner particles. Developer unit 38 contains black toner particles and may be used to develop the electrostatic latent image formed from black information or text, or to supplement the colour developments. Each of the developer units is moved into and out of an operative position. In the operative position, the magnetic brush is closely adjacent to the photoconductive belt, whereas in the non-operative position, the magnetic brush is spaced therefrom. During development of each electrostatic latent image only one developer unit is in the operative position, the remaining developer units being in their non-operative one. This ensures that each electrostatic latent image is developed with toner particles of the appropriate colour without intermingling. In FIG. 1, developer unit 35 has been shown in its operative position. Finally, each unit comprises a toner hopper, such as hopper 39 shown for unit 35, for supplying fresh toner to the developer which becomes progressively depleted by the development of the electrostatic charge images.

Figure 2:
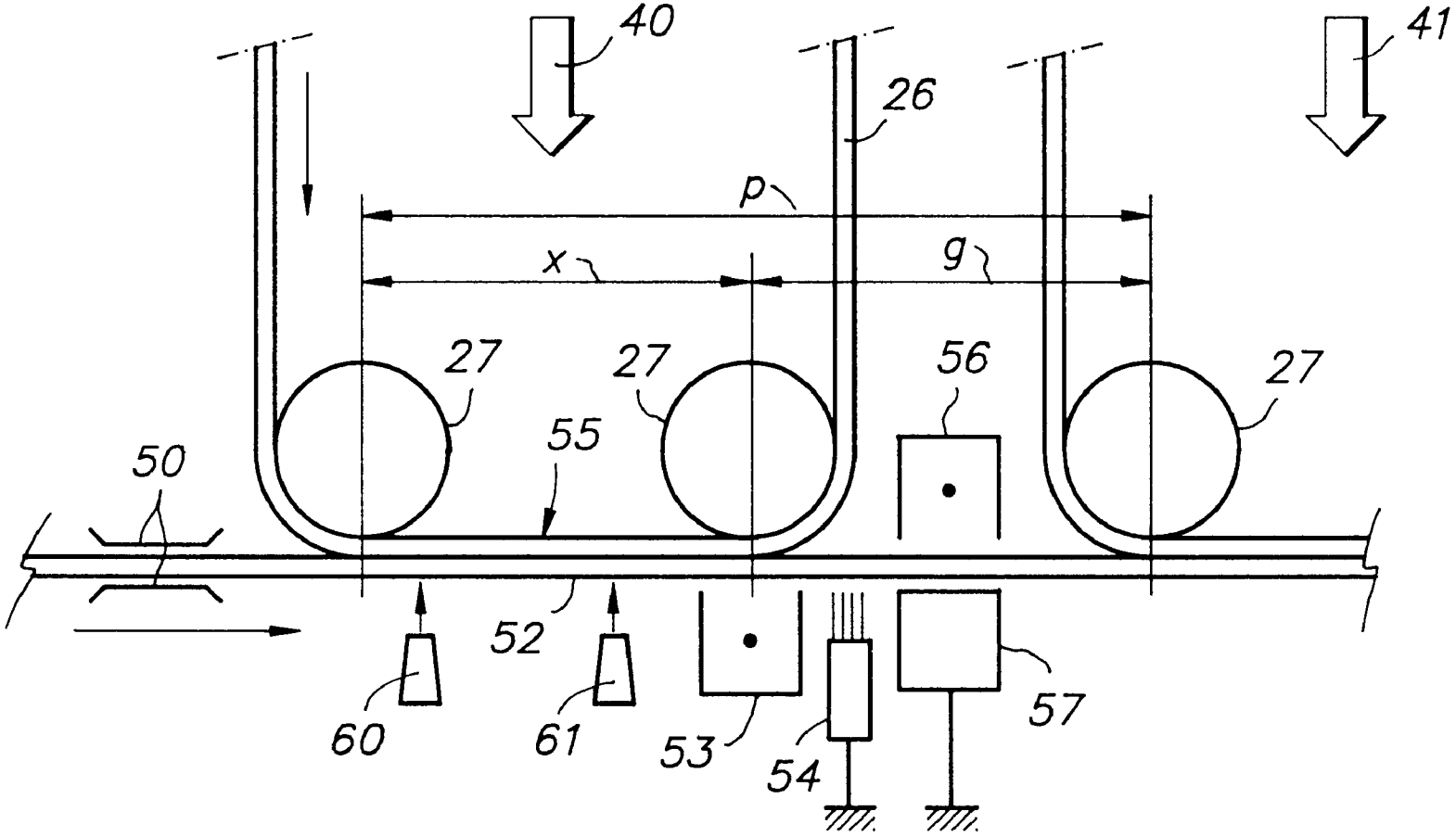
FIG. 2 is a detail of FIG. 1 showing one embodiment of a toner image transfer station.

After their development, the toner images are moved to toner image transfer stations 40, 41, 42 and 43 where they are transferred on a sheet of support material, such as plain paper or a transparent film. At a transfer station, a receptor sheet follows a rectilinear path 17 into contact with photoconductive belt 26. The sheet is advanced in perfect synchronism with the movement of the belt. Advance of the sheet and transfer of a toner image from the belt to the sheet will be described in more detail with reference to FIG. 2 hereinafter. After transfer of the four toner images, the belt follows an upward course and is cleaned in a cleaning station 45 where a rotatable fibrous brush or the like is maintained in contact with the belt 26 to remove residual toner particles remaining after the transfer operation. Thereafter, lamp 46 illuminates the belt to remove any residual charge remaining thereon prior to the start of the next cycle.

The transfer stations 40', 41', 42' and 43' and the developer units 35', 36', 37' and 38' of the image forming station 21 are similar to those of station 20.

More details about suitable transfer stations can be found in our co-pending application PCT 97/04330 entitled: "Device for electrostatically transferring toner images", whereas more details about the position of the distinct colour part images on photoconductive belt 26 and the the length of an image buffer path between two successive transfer stations can be found in our co-pending application PCT 97/04331 entitled: "Electrostatic colour printing apparatus".

The operation of the printer described hereinbefore for the production of a duplex image is as follows.

The green latent image being exposed by station 29 on photoconductive belt 26, this image is progressively developed by magenta toner station 35 being in its operative position as the belt moves therethrough. Upon completion of the end of the exposure of the green image and of occasionally a colour wedge, register marks and the like, the blue image becomes exposed. During the blue exposure, the developed magenta image is transported past inactive stations 36, 37 and 38 while toner transfer stations 40 to 43 still are inoperative too.

As the development of the green latent image is finished, magenta development station 35 is withdrawn to its inoperative position and after the trailing edge of the magenta image has passed yellow development station 36, this station is put in the operative position to start the development of the blue latent image. While the latter portion of the yellow latent image is being developed, the exposure of the red latent image at 29 starts already.

The described processes of imagewise exposure and colour development continue until the four colour separation images have been formed in successive spaced relationship on the photoconductive belt.

A receptor sheet 52 which has been taken from stack 12, properly aligned in aligner 16 and kept in readiness, is then advanced by rollers 47 in timed relation to the position of the toner images on belt 26. The electrostatic transfer devices of the transfer stations are energized, and as sheet 52 reaches toner transfer station 40 where at that moment the lastly formed toner image is ready to enter the station, toner image transfer can start. Thus, the lastly formed toner image is first to become transferred to sheet 52. The firstly formed toner image takes with its leading edge a position on the belt as indicated by the cross 62 and will thus be transferred last. The other two toner images take positions with their leading edges as indicated approximately by crosses 63 and 64, respectively.

The timing of exposure of the four distinct images, the relative position of these images on the photoconductive belt and the lengths of the path of this belt between the successive transfer stations are such that as paper sheet 52 follows a linear path through these stations, the progressive simultaneous transfer of the distinct toner images to the paper sheet is such that a perfect registering of these images is obtained.

Sheet 52 bearing a colour toner image on its obverse side produced as described hereinbefore, is now passed through image forming station 21 for applying a colour toner image to the reverse side of the sheet. The production of the reverse side part images started in timed relationship to the obverse side ones, so that the positions of the images on both sheet sides correspond with each other. The cross-over of the sheet from station 20 to station 21 does not raise any problem since basically this transfer is the same as the transfer of the sheet from one to the next image transfer station.

The sheet electrostatically bearing the colour images is then received on endless belt 24 of buffer station 23 before entering fuser station 25.

The purpose of buffer 23 is as follows. Fuser station 25 operating to melt the toner images transferred to the sheets in order to affix them, it will be understood that this operation requires a certain minimum time since the temperature of the fuser is subject to an upper limit which must not be exceeded, unless the roller lifetime becomes unsatisfactory.

In other words, the speed of fuser station 25 is limited. The speed of the image formation stations 20 and 21, on the other hand, is in principle not limited for any particular reason. On the contrary, it is advantageous to use a high speed of image formation and image transfer, since the four colour separations of each colour image are written by exposure head 29 in succession, which means that the recording time of one colour image amounts to at least four times the recording time of one part image.

All this means a relatively high speed of the photoconductive belts, and thus of the synchronously moving sheets, as compared with a maximum usable travelling speed through the fuser station. In the apparatus according to the present embodiment, the speed of the two photoconductive belts amounted to 295 $mm.s^{-1}$, whereas the fusing speed was 100 $mm.s^{-1}$ or less.

Further, it may be desirable to adjust the fusing speed independently from the image processing speed, i.e. the belt speed, for obtaining optimum results. It should be noted that the image processing speed in the imaging stations is constant.

The length of buffer station 23 is sufficient for receiving the largest sheet size to be processed in the apparatus.

Buffer station 23 operating initially at the speed of the photoconductive belts of devices 20 and 21, the speed of this station is reduced to the processing speed of fuser station 25 as the trailing edge of the sheet has left device 21.

Fusing station 25 can be of known construction, and can be arranged for radiation or flash fusing, for fusing by convection and/or by pressure, etc. The fused sheet is finally received on platform 14.

The sheet bearing the fused image is finally received in tray 14.

The use of the apparatus described hereinbefore for the simultaneous production of two simplex prints at a time is as follows.

First, dispenser mechanism 15 is controlled to feed two sheets in succession from stack 12 into aligment station 16. This station duly positions both sheets. This positioning may include making both sheets coincide, but the sheets may also be slightly longitudinally shifted so that the leading margin of the foremost sheet may allow an easy separation of both sheets after their processing.

Second, the apparatus suitably comprises a sheet inverter as show by block 88 in dashed lines in FIG. 1 for reversing the front-rear side position of one of every two paired simplex prints so that the sheets are collected in tray 14 with their images all on the same side.

Finally, IPS 31 is preferably adjusted by the operator through UI 32 in such a way that one of the images on two registered sheets is printed in a reversed top-bottom location. As a matter of fact, the front-rear-side reversing of one sheet with respect to the other of each twin locates the simplex images on the same side of the sheets in output tray 14, it is true, but the top-bottom location of the image of the reversed sheets is opposite to that of the non-reversed sheets. The electronic reversing of one of every two images obviates the described inconvenience.

Figure 3:
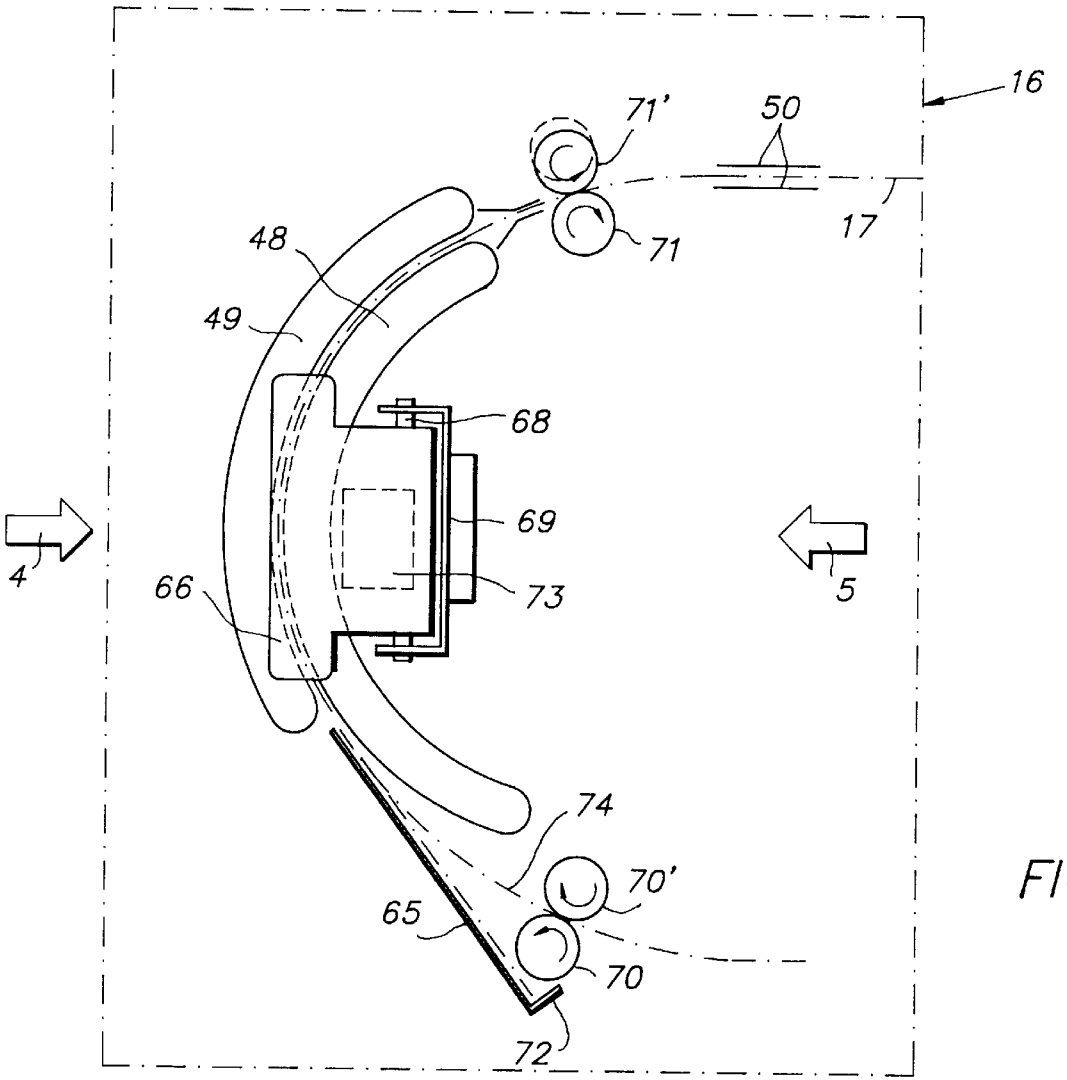
FIG. 3 is a detail of rectangle 16 of FIG. 1, showing diagrammatically one embodiment of an aligning mechanism for longitudinally and transversely aligning two sheets.

One embodiment of mechanism 16 for carrying out the required aligning of two sheets is shown diagrammatically in FIG. 3. The sheet joggler system comprises a driven inlet roller pair 70,70', a driven outlet roller 71 and a co-operating non-driven roller 71' which has a closed position and an open one shown in dashed lines, a number of concentric laterally spaced curved sheet guides 48 and 49, a stationary plate 65 with stop 72 for the longitudinal sheet registering, two lateral aligning plates 66,67 (66 only being shown) at opposite lateral sides of the curved sheet path between guides 48, 49 for the lateral sheet registering, and outlet channel 50.

Plates 66, 67 can be metal plates with a T-like shape as shown approximately. One plate can take a stationary position while the other one can be swingable about a pivot 68 mounted in a stationary bracket 69, and actuated by electrical means represented by block 73 in dashed lines, which in the present example is an A.C. electromagnet.

The operation of the apparatus for the aligning of two sheets is as follows.

Dispenser roller 15 is activated to remove two sheets in succession from stack 12, this in response to the appropriate setting of IPS 31. As the first sheet is received in joggler system 16, roller pair 70,70' drives the sheet until its leading end extends through the gap between opened rollers 71,71'.

As the trailing sheet end is no longer engaged by rollers 70,70', roller 70 moves the trailing sheet edge away from its path 74 in the direction towards plate 65. Then the sheet falls in the gap between roller 70 and plate 65 until it abuts against sheet stop 72.

The second sheet follows the same path and it is likewise led with its trailing edge in contact with stop 72 of plate 65. During or after the described longitudinal registering plate 66 is pulled by electromagnet 73 a number of times in the direction of plate 67 whereby the sheets become laterally aligned. The lateral sheet movements contribute to the rapid longitudinal registering of the sheets. Next roller 71' is closed whereby both sheets are simultaneously advanced through guide 50 to the first imaging station 20, along path 17. Electrostatic attraction forces produced by the coronas of the different transfer stations 40–43 ensure a firm frictional contact between both sheets so that their registering is maintained after the driving contact with rollers 71,71' is broken.

When the leading end of the sandwich of both sheets enters image forming station 21, image transfer on the lower sheet is started. It will be understood that at this moment image formation on the trailing portion of the upper sheet is still going on. As mentioned already hereinbefore, image formation in station 21 is top-to-bottom reversed as compared with the one in station 20.

Figure 4:
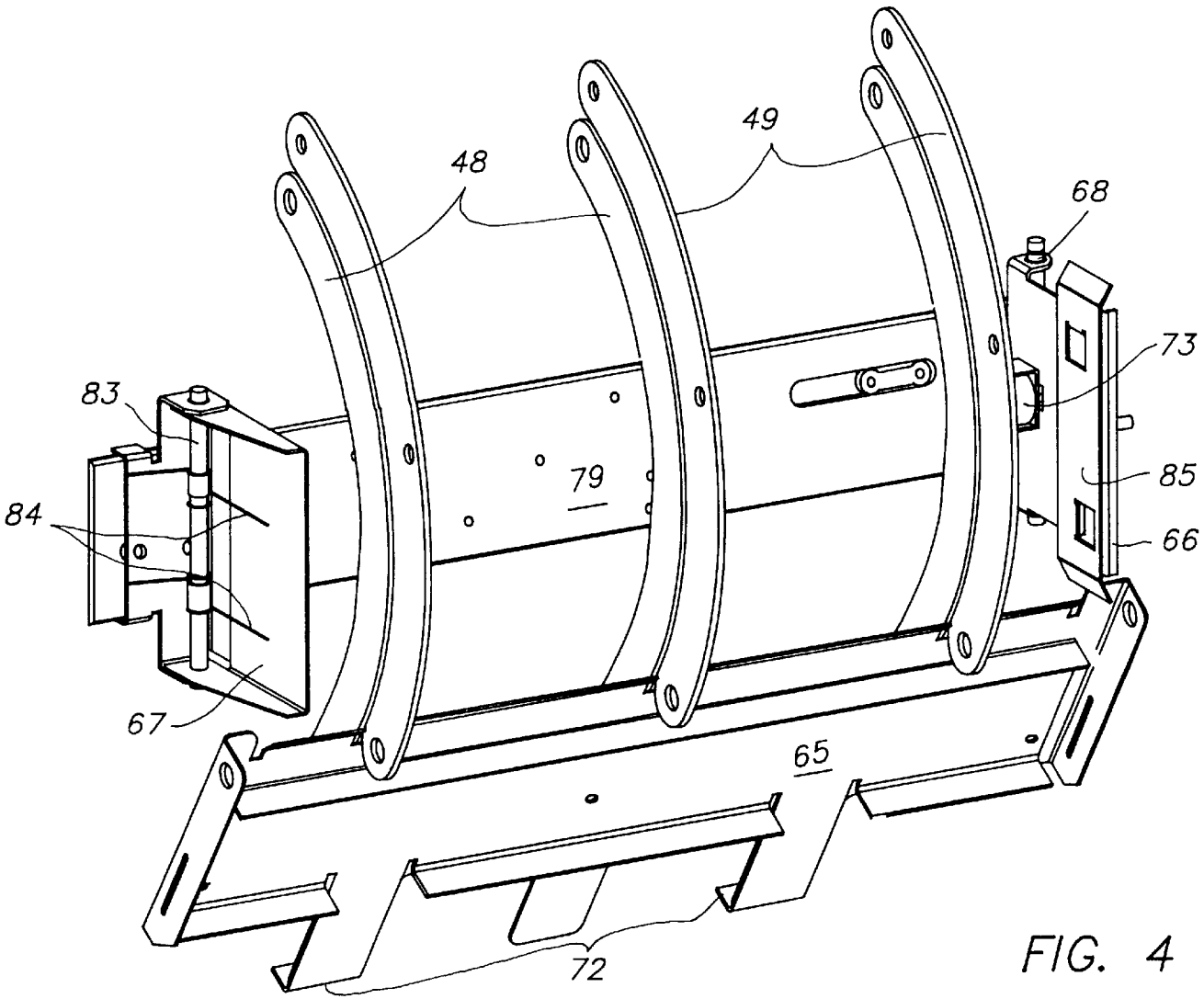
FIG. 4 is a rear view of the mechanism of FIG. 3, showing constructive details.
Figure 5:
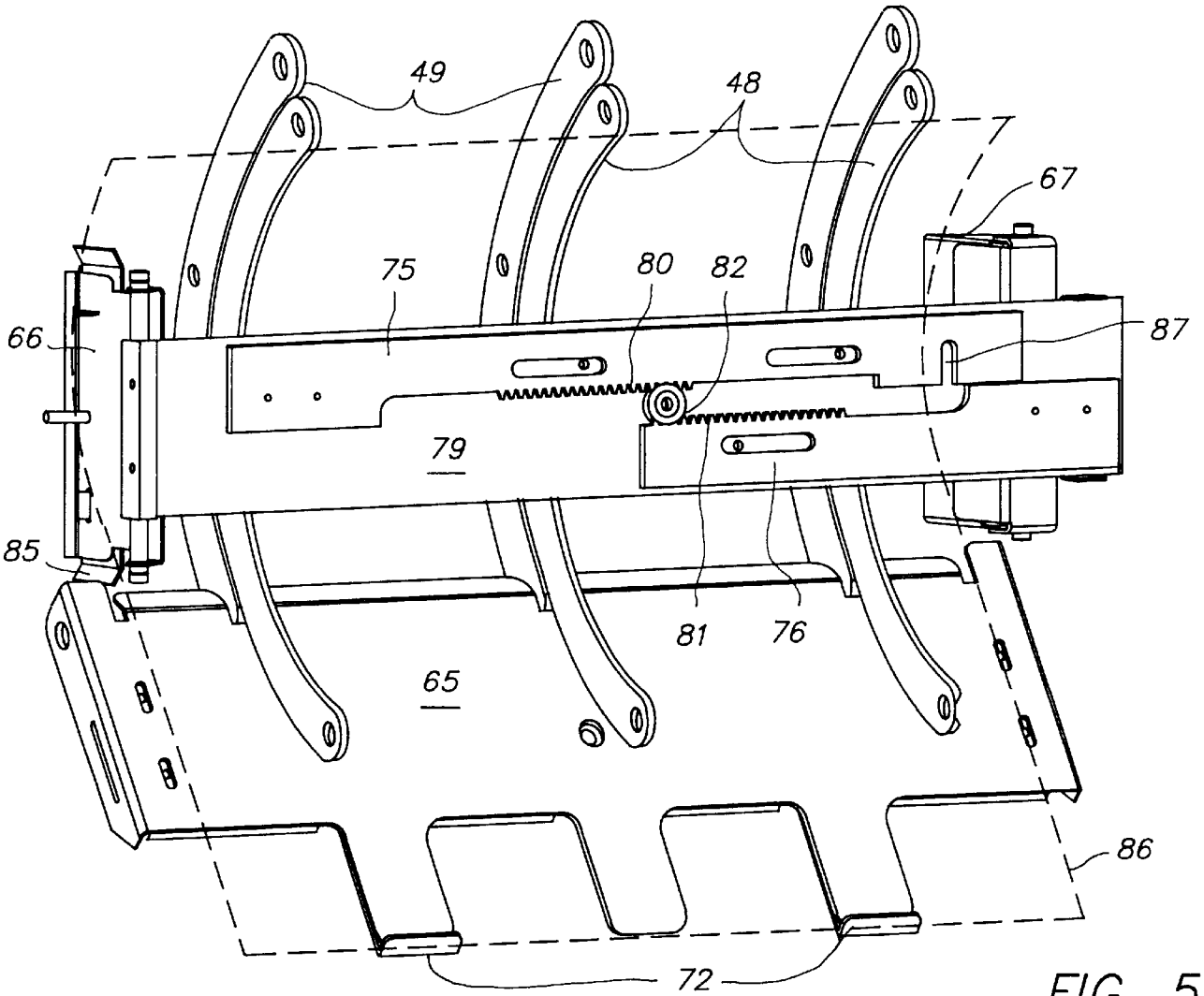
FIG. 5 is a front view of the mechanism of FIG. 3 showing likewise a number of construction details.

The sheet joggler system is shown in detail in the perspective views of FIGS. 4 and 5, FIG. 4 being a view according to arrow 4 and FIG. 5 according to arrow 5 of FIG. 3.

Lateral sheet aligning plates 66 and 67 are fitted to corresponding sliding bars 75 and 76 which through corresponding slot-and-pin guides are mounted for parallel adjustment on a transverse beam 79. Both bars have mutually facing toothed racks 80 and 81 intercoupled by pinion 82 so that the width of a sheet path determined by plates 66 and 67 is adjustable around a center point of the mechanism. Guides 48, 49, plate 65 and beam 79 form one unit. Stop 72 is actually formed by two fingers in the form of angled extensions of plate 65.

Joggler plate 67 preferably is mounted for slightly yielding motion so that it can accommodate to sheet sizes which occasionally are slightly larger than a given value. This is obtained in the present embodiment by making this plate pivotable about a pin 83, wire spring 84 biasing the plate towards opposed plate 66.

Joggler plate 66 may be arranged for slight yielding as well, in order to avoid damaging of the side edge of a sheet. This may be obtained through a lining such as 85 which covers the active part of the plate and may be connected in parallel therewith through leaf springs or the like. Dashed lines 86 indicate the position of a sheet in the drawing of FIG. 5.

The invention is not limited to the embodiment described thereinbefore.

As mentioned already, the sheet joggler system can be used for the alignment of one, two or more sheets.

Actuation of movable plate 66 can also occur by other motor means than an electromagnet, e.g. through a crank and crank arm mechanism, by a rotating cam, through the oscillation of a rotatable eccentric mass, etc.

Adjustment of the sheet width of the system can be done manually, but is preferably done automatically. According to one suitable embodiment, bar mechanism 75, 76 is mechanically coupled with the platform which supports a stack of sheets to be processed. The size of such platform corresponds to the sheet size. A simple lever mechanism can sense the width of the platform and transmit this position via an arm engaging slot 87 of arm 75 so that its position is made to match the sheet size, arm 76 following the adjustment in the opposite direction.

The direction of movement of a sheet along its curved path need not necessariily be substantially upwardly, but may also be generally oblique or even horizontally.

Adjustment of the longitudinal position of a sheet may also occur by abutment of its leading instead of its trailin edge against a reference stop. In the latter case, the stop may be arranged for withdrawal after the positioning of the sheet, so that then the sheet transport may continue.

PARTS LIST

10 housing
12 sheet stack
13, 14 platform
15 dispenser
16 aligner
17 sheet path
18 outlet
20, 21 image forming stations
23 buffer station
24 transport belt

25 fuser
26 photoconductive belt
27 idler rollers
28 charging station
29 exposure station
30 ROS
31 IPS
32 UI
34 input
35, 36, 37, 38 developer units
39 hopper
40, 41, 42, 43 image transfer stations
45 cleaning station
46 lamp
47 driving rollers
48, 49, 50 guides
52 sheet
53 corona
54 brush
56 corona
57 grounding
60, 61 air jets
62, 63, 64 crosses
65 longitudinal registering plate
66, 67 lateral registering plates
68 pivot
69 bracket
70, 70' input rollers
71, 71' output rollers
72 stop
73 motor
74 sheet path
75, 76 sliding bars
79 beam
80, 81 racks
82 pinion
83 pin
84 spring
85 lining
86 sheet
87 slot
88 sheet inverter.

We claim:

1. Method for longitudinally and transversely positioning at least one sheet, comprising feeding such sheet along a path which is curved around an axis which is transverse with respect to the sheet path and thus supporting the sheet, stopping the feeding of the sheet by causing the sheet to abut with an edge against a fixed stop in order to obtain its desired longitudinal positioning, and causing while the sheet is on said curved path also a lateral displacement of the sheet in order to obtain its desired lateral positoning while at the same time increasing the mobility of the supported sheet to become positioned longitudinally.

2. Method according to claim 1, comprising feeding such sheet(s) at the end of said curved path between a driving roller pair taking an opened position prior to the aligning of the sheet(s), and a closed one after such aligning for driving said sheet(s) towards a processing station.

3. Method according to claim 1, comprising feeding said sheet(s) towards said path by means of a driven roller pair, one of said rollers causing the trailing end of the sheet(s) to become displaced away from its initial path towards support means near to said one roller determining with said roller a gap in which the trailing sheet end can move backwardly.

4. Method according to claim 1, wherein said fixed stop is provided under said gap.

5. Method according to claim 1, used for the positioning of two sheets taken from of a stack of print sheets in the simultaneous production of two simplex prints by means of a duplex printer.

6. Method according to claim 1, comprising feeding at least two sheets along such curved path to become positioned.

7. Method according to claim 6, comprising providing stops at different positions according to the transport direction of the sheets, to cause a certain longitudinal misalignment of the sheets.

8. Method according to claim 1, comprising moving said sheet along said curved path in a first direction, and next moving said sheet backwardly until its edge which was trailing during said first movement abuts against said fixed stop.

9. Method according to claim 8, wherein said first direction runs substantially upwardly, and said backward movement is substantially downwardly.

10. Method according to claim 9, wherein said backward movement of the sheet occurs solely under the influence of gravity.

11. Sheet joggler system which comprises a driven sheet inlet roller pair (70,70'), a driven sheet outlet roller pair (71,71') having a closed and an open position, sheet guides (48,49) determining between both said roller pairs a generally upward sheet path (74) which is curved around an axis which is transverse to the sheet path, sheet supporting means (65) between said inlet roller pair and said sheet guides, which extends past one roller of said inlet roller pair and which determines therewith a gap in which said sheet can enter with its trailing end when leaving said roller pair and next moving backwardly, and a sheet stop (72) at the lower end of said sheet supporting means for contact with the trailing edge of a sheet thereby to longitudinally align such sheet, and means (66,67) located at both lateral sides of said curved sheet path for contacting the lateral edges of a sheet to also laterally align such sheet.

12. Sheet joggler system according to claim 11, wherein the rollers (70,70') of said inlet roller pair are located at different heights, and wherein said sheet supporting means extends past the lower located roller (70) of said roller pair.

13. Sheet joggler system according to claim 11, wherein said means for the lateral sheet alginment comprise a stationary plate (67) on one side of the curved sheet path and a movable one (66) at the opposite side of such path, and means (73) for causing said movable plate to carry out repeated movements in the direction of the other plate.

14. Sheet joggler system according to claim 13, wherein said stationary plate (67) is arranged for limited displacements to accomodate to sheet width tolerances.

15. Sheet joggler system according to 14, wherein said lateral sheet alignment plates are mounted on a mechanism allowing different sheet widths to be set.

16. Sheet joggler system according to claim 15, wherein said mechanism comprises two toothed parallel bars (75,76) slideable in parallel, and inter-coupled by a pinion (82) so that they are movable in opposed directions.

17. Sheet joggler system according to claim 15, wherein said mechanism is controlled by sensing the width of a stack of sheets from which sheets are taken one by one.

* * * * *